US011571071B2

(12) United States Patent
Hosokawa et al.

(10) Patent No.: US 11,571,071 B2
(45) Date of Patent: Feb. 7, 2023

(54) CONTROL DEVICE AND ELECTRIC FURNITURE

(71) Applicant: PARAMOUNT BED CO., LTD., Tokyo (JP)

(72) Inventors: Yuji Hosokawa, Tokyo (JP); Takaki Matsumoto, Tokyo (JP); Masato Shimokawa, Tokyo (JP); Tomoki Yoshida, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 791 days.

(21) Appl. No.: 16/481,805

(22) PCT Filed: Apr. 12, 2018

(86) PCT No.: PCT/JP2018/015335
§ 371 (c)(1),
(2) Date: Jul. 29, 2019

(87) PCT Pub. No.: WO2018/216388
PCT Pub. Date: Nov. 29, 2018

(65) Prior Publication Data

US 2019/0374039 A1 Dec. 12, 2019

(30) Foreign Application Priority Data

May 26, 2017 (JP) ..... JP2017-104152

(51) Int. Cl.
*A47C 20/04* (2006.01)
*A47C 31/00* (2006.01)
(Continued)

(52) U.S. Cl.
CPC ..... *A47C 20/041* (2013.01); *A47C 31/008* (2013.01); *A61G 7/018* (2013.01);
(Continued)

(58) Field of Classification Search
CPC ..... A47C 20/041; A47C 20/04; A47C 17/04; A47C 31/008; A61G 7/018; A61G 7/002;
(Continued)

(56) References Cited

U.S. PATENT DOCUMENTS 7,636,604 B2 * 12/2009 Bergman ..... G05B 19/106 700/83
9,746,996 B2 * 8/2017 Choi ..... B60H 1/00985
(Continued)

FOREIGN PATENT DOCUMENTS

CN 104515259 A 4/2015
JP 2006346311 A 12/2006
(Continued)

OTHER PUBLICATIONS

Chinese Office Action dated Oct. 16, 2020, mailed in counterpart Chinese Application No. 201880015734.3, 15 pages (with translation).
International Search Report dated Jun. 27, 2018, mailed in counterpart International Application No. PCT/JP2018/015335, 8 pages.

*Primary Examiner* — Robert G Santos
(74) *Attorney, Agent, or Firm* — Kim & Stewart LLP

(57) ABSTRACT

According to an embodiment, a control device includes multiple operation buttons, an acceptance part, and a displayer. The multiple operation buttons can control an operation of a movable part of electric furniture. In a first state in which the acceptance part receives a first input, the displayer displays a first display between the multiple operation buttons. A bed system is provided in which the ease of use can be improved. A control device and electric furniture are provided in which the operationability can be improved.

16 Claims, 13 Drawing Sheets

(51) Int. Cl.
*A47C 17/04* (2006.01)
*A61G 7/018* (2006.01)
*A61G 13/02* (2006.01)

(52) U.S. Cl.
CPC ..... *A61G 13/02* (2013.01); *A47C 17/04* (2013.01); *A61G 2203/12* (2013.01); *A61G 2203/20* (2013.01)

(58) Field of Classification Search
CPC ..... A61G 7/015; A61G 13/02; A61G 13/08; A61G 2203/12; A61G 2203/30
USPC ..... 5/600, 613, 616–618; 700/275
See application file for complete search history.

(56) References Cited

U.S. PATENT DOCUMENTS

| | | | | |
|---|---|---|---|---|
| 10,932,968 | B2 * | 3/2021 | Hosokawa | A61G 7/05 |
| 2006/0030954 | A1 * | 2/2006 | Bergman | B60H 1/00985 700/20 |
| 2015/0094861 | A1 | 4/2015 | Choi et al. | |
| 2019/0374039 | A1 * | 12/2019 | Hosokawa | A47C 31/008 |
| 2020/0060908 | A1 * | 2/2020 | Hosokawa | A47C 31/008 |

FOREIGN PATENT DOCUMENTS

| | | | | |
|---|---|---|---|---|
| JP | 2009257668 | A | 11/2009 | |
| JP | 2012040146 | A | 3/2012 | |
| JP | 5640023 | B2 | 12/2012 | |
| JP | 2013144045 | A | 7/2013 | |
| WO | WO-2018198785 | A1 * | 11/2018 | A47C 17/04 |
| WO | WO-2018216388 | A1 * | 11/2018 | A47C 20/041 |

* cited by examiner

CONTROL DEVICE AND ELECTRIC FURNITURE

TECHNICAL FIELD

An embodiment of the invention relates to a control device and electric furniture.

BACKGROUND ART

For example, there are electric furniture (e.g., an electric bed, an electric reclining chair, etc.) in which the angle of the backrest and/or the height are modifiable. These electric furniture are operated by a control device (e.g., a remote controller: remote control) such as a handy switch, etc. It is desirable to improve the operationability of such a control device.

PRIOR ART DOCUMENTS

Patent Literature

[Patent Literature 1]
Japanese Patent No. 5640023

SUMMARY OF INVENTION

Problem to be Solved by the Invention

An embodiment of the invention provides a control device and electric furniture in which the operationability can be improved.

Means for Solving the Problem

According to an embodiment, a control device includes multiple operation buttons, an acceptance part, and a displayer. The multiple operation buttons can control an operation of a movable part of electric furniture. In a first state in which the acceptance part receives a first input, the displayer displays a first display between the multiple operation buttons.

According to another embodiment, electric furniture that includes the movable part and the control device recited above is provided.

Effects of the Invention

An embodiment of the invention can provide a control device and electric furniture in which the operationability can be improved.

MODES FOR CARRYING OUT THE INVENTION

Figure 1A:
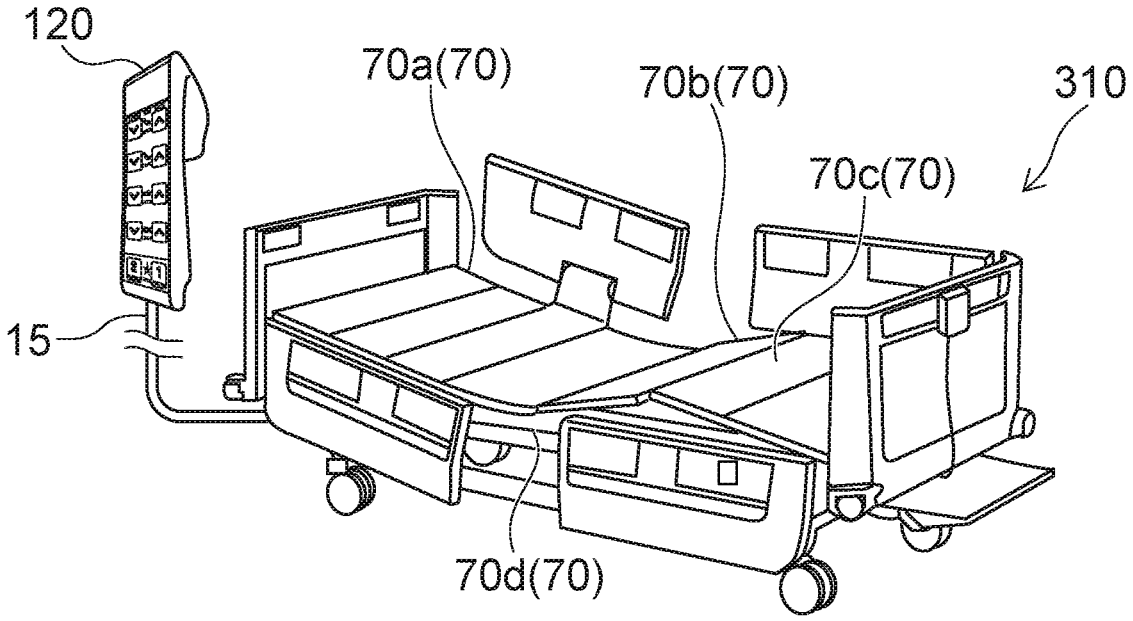
FIG. 1A to FIG. 1C are schematic perspective views illustrating a control device and electric furniture according to an embodiment.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with the same reference numerals; and a detailed description is omitted as appropriate.

Figure 1B:
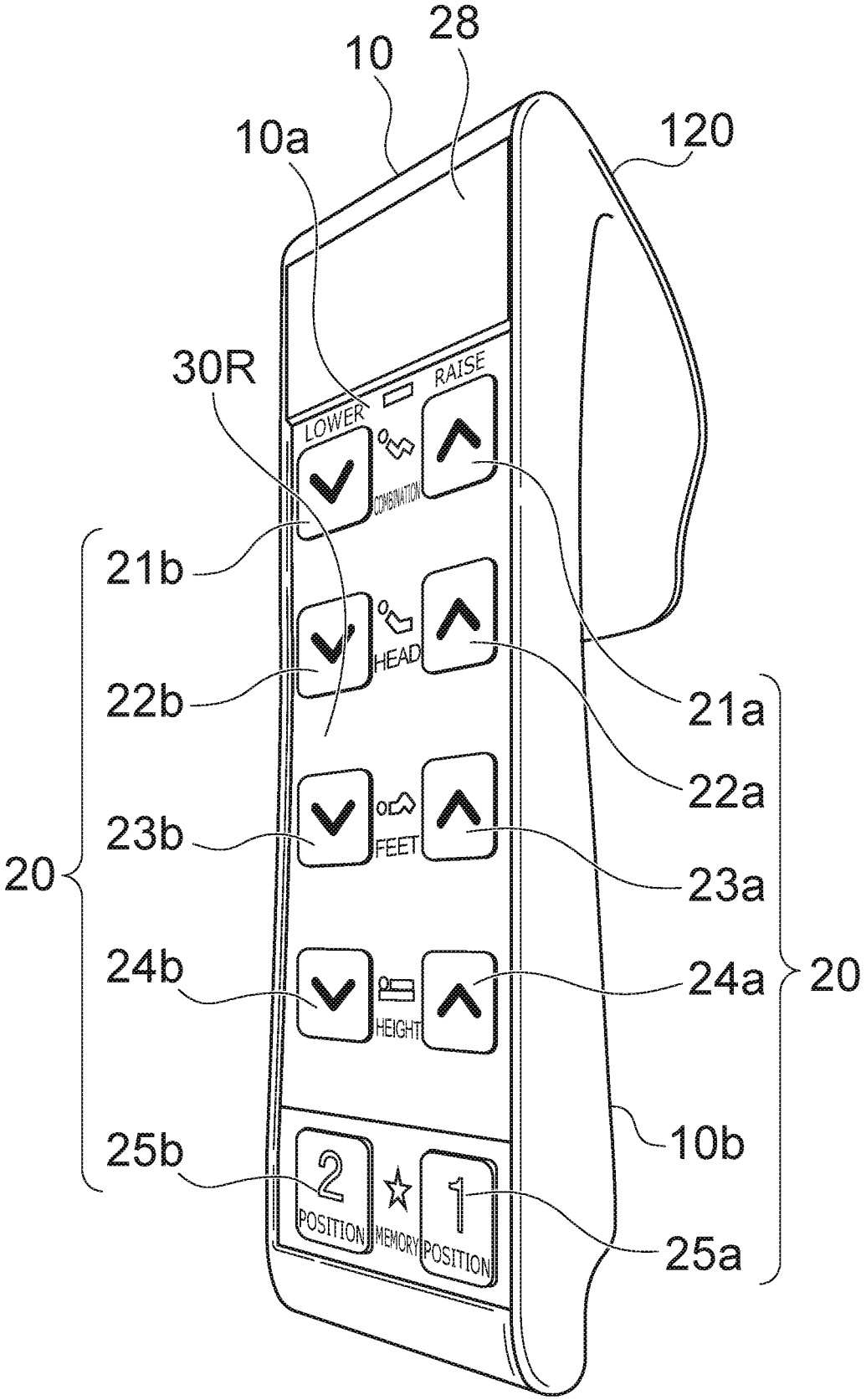
Figure 1C:
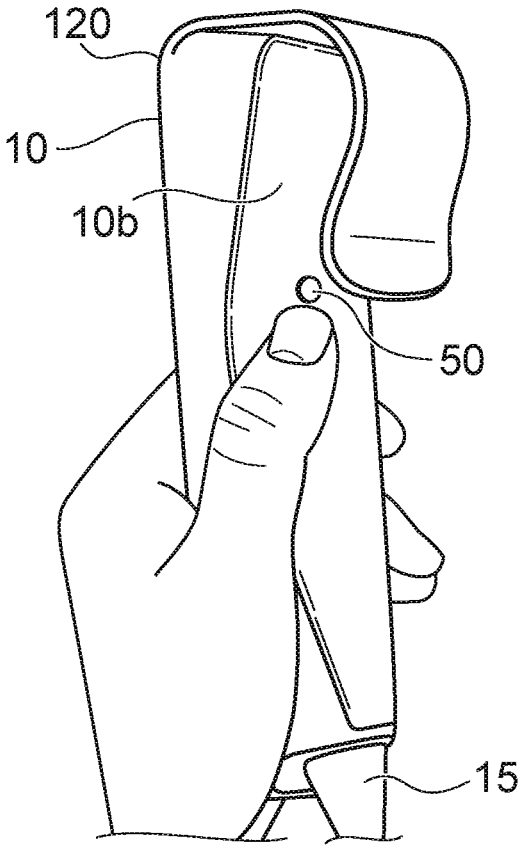

FIG. 1A to FIG. 1C are schematic perspective views illustrating a control device and electric furniture according to the embodiment.

As shown in FIG. 1A, the control device 120 according to the embodiment is used with the electric furniture 310. The control device 120 can control a movable part 70 of the electric furniture 310. The control device 120 is, for example, a remote controller (a remote control) of the electric furniture 310. The control device 120 is, for example, a handy switch. The control device 120 may include various functions such as an ON/OFF function of lighting, a paging function of a nurse or a caregiver, an ON/OFF function of a power supply, etc.

For example, the electric furniture 310 is used in a hospital, a care facility, a household, etc.

In the example, the electric furniture 310 is an electric bed. The electric bed includes the movable part 70. The movable part 70 includes, for example, a back section 70*a*, an upper leg section 70*b*, a lower leg section 70*c*, a height adjuster 70*d*, etc. The angles between the back section 70*a*, the upper leg section 70*b*, and the lower leg section 70*c* are modifiable. The angle of the back of the user is modifiable by the operation of the back section 70*a*. The angle of the knees is modifiable by modifying the angle between the upper leg section 70*b* and the lower leg section 70*c*. These angles may be changed in combination. For example, the height adjuster 70*d* can modify the distance (the height) between the floor surface and the bed surface. These movable parts 70 include, for example, actuators, etc. By the operations of the movable parts 70, at least one of "back-raising," "knee-raising," "height adjustment," or the like is possible.

The control device 120 is electrically connected to the movable part 70 recited above. A control circuit may be provided between the control device 120 and the movable part 70. Thus, the case where another circuit is provided therebetween also is included in the state of being electrically connected.

As shown in FIG. 1A, the control device 120 is connected to the electric furniture 310 by a cable 15. The control device 120 may be connected to the electric furniture 310 by wireless communication. The control device 120 includes an operation part 10.

As shown in FIG. 1B and FIG. 1C, the control device 120 (the operation part 10) has a first surface 10*a* and a second surface 10*b*. The second surface 10*b* is the surface on the side opposite to the first surface 10*a*. The first surface 10*a* is, for example, the surface on the front side. The second surface 10*b* is, for example, the back surface. The first surface 10*a* is, for example, the operation surface.

The control device 120 includes multiple operation buttons 20 and an acceptance part (e.g., a switch 50).

The acceptance part is, for example, a hardware switch or a software-controlled switch. In the following example, a hardware switch 50 is used as the acceptance part.

The multiple operation buttons 20 are provided at the first surface 10*a*. For example, the switch 50 is provided at a part other than the first surface 10*a*. In the example, the switch 50 is provided at the second surface 10*b*. The switch 50 may be provided at a side surface of the housing of the control device 120.

The control device 120 includes an operation mode and a setting mode. In the operation mode, the movable part 70 is controlled by operating the operation buttons 20. Various settings are performed in the setting mode. The operation mode is employed in the normal state of use. For example, the setting mode is employed in the "setting state" that is different from the normal use.

Switching of the operation mode and the setting mode are performed by the switch 50 (one example of the acceptance part). For example, the operation mode is switched to the setting mode by pressing the switch 50. For example, the setting mode is switched to the operation mode by pressing the switch 50 again.

In the operation mode, the operation of the movable part 70 of the electric furniture 310 is controlled by operating the multiple operation buttons 20. In the example, the multiple operation buttons 20 include a raise button 21*a* relating to "combination," a lower button 21*b* relating to "combination," a raise button 22*a* relating to "head," a lower button 22*b* relating to "head," a raise button 23*a* relating to "feet," a lower button 23*b* relating to "feet," a raise button 24*a* relating to "height," a lower button 24*b* relating to "height," etc.

The following is performed in the operation mode. For example, when the raise button 22*a* relating to "head" is pressed, the angle of the back section 70*a* increases. For example, when the lower button 22*b* relating to "head" is pressed, the angle of the back section 70*a* decreases. For example, when the raise button 23*a* relating to "feet" is pressed, the angles of the upper leg section 70*b* and the lower leg section 70*c* increase. For example, when the lower button 23*b* relating to "feet" is pressed, the angles of the upper leg section 70*b* and the lower leg section 70*c* decrease. These angles are, for example, angles from the horizontal plane. For example, when the raise button 24*a* relating to "height" is pressed, the bed surface becomes higher. For example, when the lower button 24*b* relating to "height" is pressed, the bed surface becomes lower. For example, when the raise button 21*a* relating to "combination" is pressed, the "head" and the "feet" change in combination. For example, when the lower button 21*b* relating to "combination" is pressed, the "head" and the "feet" change in combination. These changes are performed by the operation of the movable part 70. For example, the operations recited above are performed in the period in which the operation buttons continue to be pressed. A safe operation is obtained thereby.

In the example, the multiple operation buttons 20 further include a button 25*a* relating to a first memory position, and a button 25*b* relating to a second memory position. The following is performed in the operation mode. The first memory position is formed when the button 25*a* is pressed. The second memory position is formed when the button 25*b* is pressed. The first memory position corresponds to the state of one combination of the states of the back section 70*a*, the upper leg section 70*b*, the lower leg section 70*c*, and the height adjuster 70*d*. The second memory position corresponds to the state of another one combination of the states of the back section 70*a*, the upper leg section 70*b*, the lower leg section 70*c*, and the height adjuster 70*d*. These memory positions may be set by the operator (the user) of the control device 120 (or the electric furniture 310). These memory positions may be set by a caregiver (a nurse, etc.) of the user of the electric furniture 310.

Other than switches including mechanical contact points, the multiple operation buttons 20 may include any input device (e.g., touch switches, etc.) of an electrostatic type, an optical type, etc.

As shown in FIG. 1B, a display region 28 may be provided at the first surface 10*a*. For example, the display region 28 can display information (the angles of the sections, the height, etc.) relating to the movable part 70 of the electric furniture 310. Information that relates to the function or operating states of the multiple operation buttons 20 may be displayed in the display region 28.

In the control device 120 according to the embodiment, a display is performed in a region 30R between the multiple operation buttons 20 when the acceptance part (e.g., the switch 50) receives an input. An example of the display will now be described.

Figure 2A:
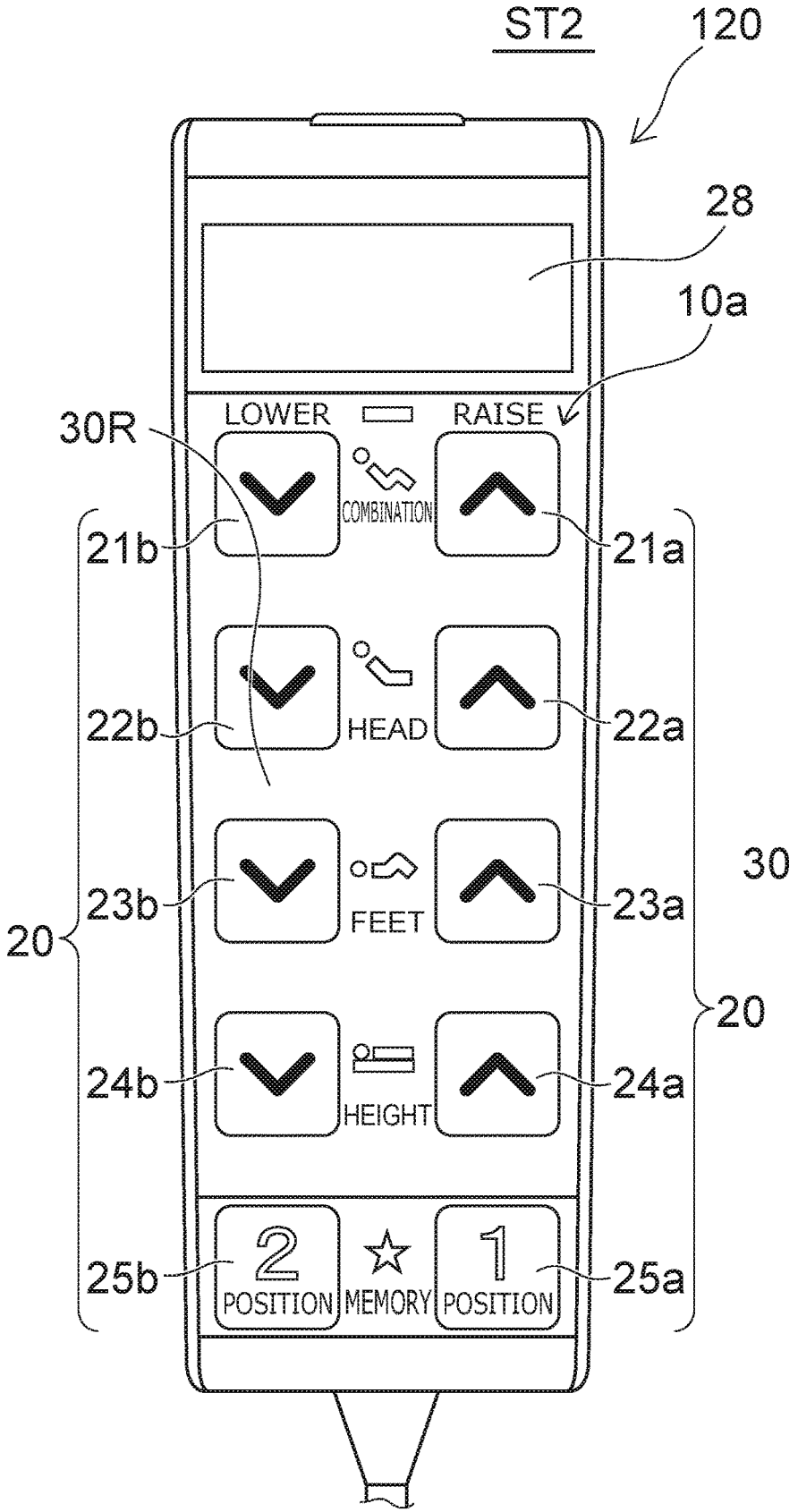
FIG. 2A and FIG. 2B are schematic plan views illustrating the control device according to the embodiment.
Figure 2B:
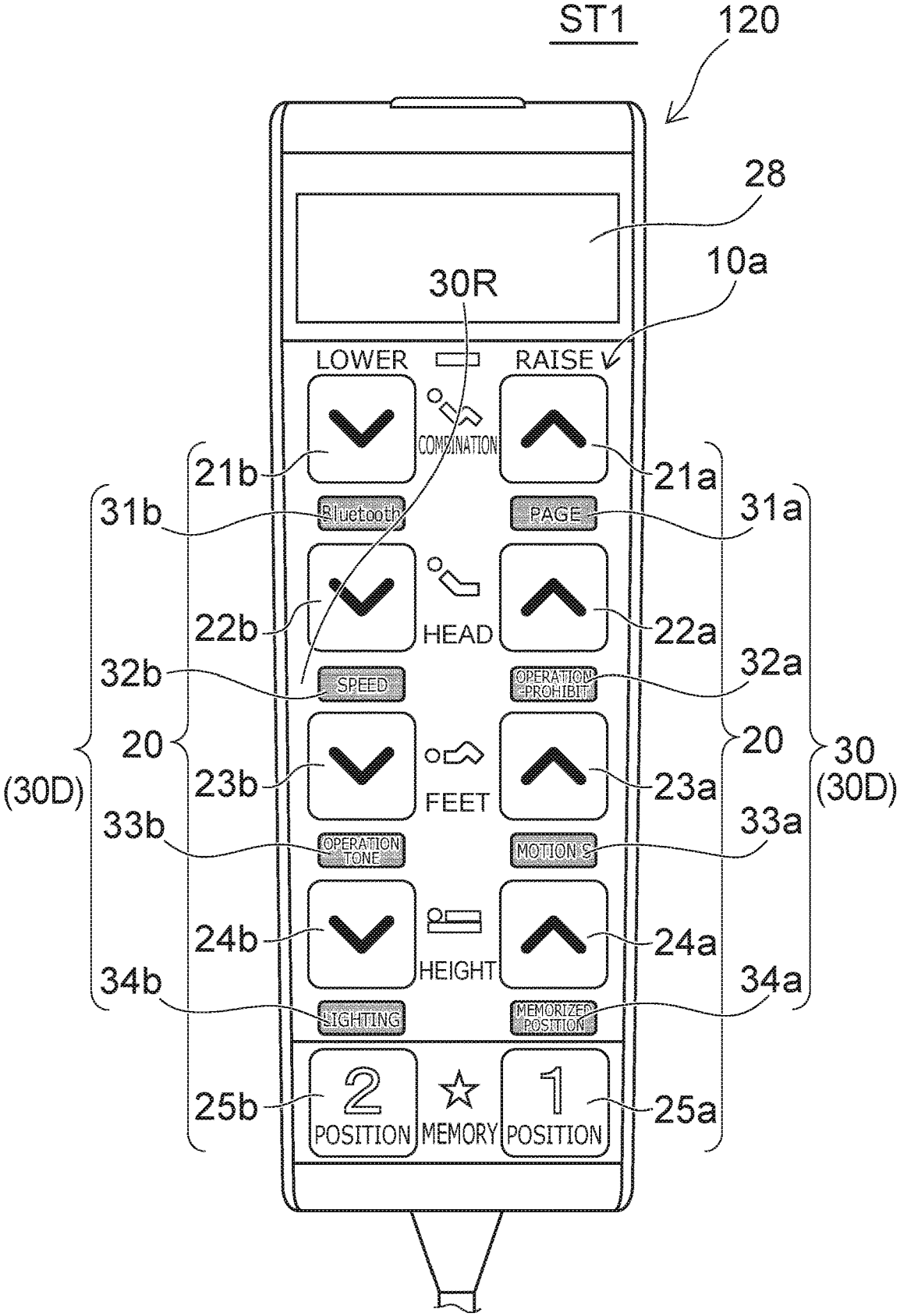

FIG. 2A and FIG. 2B are schematic plan views illustrating the control device according to the embodiment.

For example, FIG. 2A illustrates the operation mode (a second state ST2). FIG. 2B illustrates the setting mode (a first state ST1). The setting mode (the first state ST1) is the state when the acceptance part (e.g., the switch 50) receives an input (a first input).

As shown in FIG. 2B, the control device 120 includes a displayer 30. In the first state ST1 (the setting mode in which the switch 50 receives the first input), the displayer 30 displays a first display 30D between the multiple operation buttons 20. In the example, the displayer 30 includes a paging setting display 31*a*, a short-range wireless communication setting display 31*b*, an operation-prohibit setting display 32*a*, a speed setting display 32*b*, a "motion S" setting display 33*a*, an operation tone setting display 33*b*, a "memorized position" setting display 34*a*, and a lighting setting display 34*b*. At least a part of the first display 30D is displayed in the region 30R between the multiple operation buttons 20.

As shown in FIG. 2A, the display is not performed by the displayer 30 recited above in the second state ST2 (the operation mode).

The first display 30D recited above is not performed in the operation mode corresponding to the normal state of use. The user feels that the operation buttons 20 are easy to understand because an unnecessary display is not displayed. The operationability improves.

On the other hand, when switched to the setting mode, a display (the first display 30D) that corresponds to the various setting items is performed.

For example, the button 21*a* that is positioned above the paging setting display 31*a* functions as an inputter for a paging setting in the setting mode. For example, by the operation of the button 21*a*, the conditions of the paging setting, etc., are modified.

For example, the button 21*b* that is positioned above the short-range wireless communication setting display 31*b* functions as an inputter for a short-range wireless communication setting in the setting mode. For example, by the operation of the button 21*b*, the conditions of the short-range wireless communication setting, etc., are modified.

For example, the button 22*a* that is positioned above the operation-prohibit setting display 32*a* functions as an inputter for an operation-prohibit setting in the setting mode. For example, by the operation of the button 22*a*, the ON/OFF of the operation-prohibit is modified.

For example, the button 22*b* that is positioned above the speed setting display 32*b* functions as an inputter for a speed setting in the setting mode. For example, by the operation of the button 22*b*, the speed of the operation of the movable part 70, etc., are modified.

For example, the button 23*a* that is positioned above the "motion S" setting display 33*a* functions as an inputter for a "motion S" setting in the setting mode. The "motion S" is, for example, an input (a motion sensor) detecting the movement of the limbs, etc. For example, by the operation of the button 23*a*, the conditions that relate to the setting of the "motion S" are modified. For example, the ON/OFF of the motion sensor may be switched.

For example, the button 23*b* that is positioned above the operation tone setting display 33*b* functions as an inputter for an operation tone setting in the setting mode. For example, by the operation of the button 23*b*, the conditions of the operation tone are modified. The ON/OFF of the operation tone may be switched.

For example, the button 24*a* that is positioned above the "memorized position" setting display 34*a* functions as an inputter for setting the "memorized position" (the stored posture) in the setting mode. For example, by the operation of the button 24*a*, the state (the posture) of the movable part 70 is stored.

For example, the button 24*b* that is positioned above the lighting setting display 34*b* functions as an inputter for a lighting setting in the setting mode. For example, by the operation of the button 24*b*, the conditions that relate to the setting of the lighting are modified.

Thus, in the first state ST1 (the setting mode), the first display 30D is displayed by the displayer 30. At least a part of the first display 30D is displayed between one of the multiple operation buttons 20 and another one of the multiple operation buttons 20. In the first state ST1, the control device 120 performs an operation corresponding to the first display 30D when at least one of the one of the multiple operation buttons 20 recited above or the other one of the multiple operation buttons 20 recited above receives an input (a second input).

For example, an input (the second input) to the button 22*b* positioned above the speed setting display 32*b* is performed. At this time, for example, by the operation of the button 22*b*, the speed of the operation of the movable part 70, etc., corresponding to the first display 30D (the "speed") is modified.

On the other hand, in the second state ST2 (the operation mode), the button 22*b* functions as the lower button relating to "head." The operation (e.g., the modification of the speed of the operation of the movable part 70) that corresponds to the first display 30D (e.g., the "speed") is different from the operation (the lowering of the "head") of the multiple operation buttons 20 in the second state ST2 (the operation mode) in which the displayer 30 does not perform the first display 30D.

In the embodiment, the functions of the multiple operation buttons 20 are switched between the operation mode and the setting mode by one switch 50. Then, in the setting mode, the operation buttons 20 that correspond to the first display 30D are switched to the functions associated with the first display 30D. By performing the first display 30D at the vicinity of the operation buttons 20, the functions of the operation buttons 20 in the setting mode are easy to understand. Then, as described above, this display is not performed in the operation mode corresponding to the normal state of use. According to the embodiment, a control device and electric furniture can be provided in which the operationability can be improved.

The operation that corresponds to the first display 30D recited above (the display that is displayed by the displayer 30 in the setting mode) may include at least one of a control of a generation of a sound (the operation tone setting), a control of a short-range wireless communication (the short-range wireless communication setting), a control of paging (the paging setting), a control of an input by a motion sensor (the "motion S" setting), or a control of lighting (the lighting setting).

For example, the operations recited above that correspond to the first display 30D recited above may include at least one of the control of the storage of the state of the movable part 70 (the "memorized position" setting), the modification of the speed of the operation of the movable part 70 (the speed setting), or the switching (the operation-prohibit setting) between the acceptance and the non-acceptance of the input of the multiple operation buttons 20 in the second state ST2 (the operation mode).

On the other hand, the operations of the multiple operation buttons 20 in the second state ST2 include a control of the movable part 70 (e.g., at least one of raising or lowering). For example, the operation of at least one of the multiple operation buttons 20 in the second state ST2 may include at least one of the control of the height of the electric furniture 310 or the control of the angle between a first part of the electric furniture 310 and a second part of the electric furniture 310. For example, the control of the height of the electric furniture 310 corresponds to the control of the height adjuster 70*d*. The first part of the electric furniture 310 is, for example, one of the back section 70*a*, the upper leg section 70*b*, or the lower leg section 70*c*. The second part of the electric furniture 310 is, for example, another one of the back section 70*a*, the upper leg section 70*b*, or the lower leg section 70*c*.

Thus, the functions of the multiple operation buttons 20 are modified in the first state ST1 in which the first display 30D is performed and the second state ST2 in which the first display 30D is not performed.

The displayer 30 includes, for example, a semiconductor light-emitting element (a Light Emitting Diode, etc.). The displayer 30 may include, for example, a backlight and an optical switch (e.g., a liquid crystal display element, etc.).

For example, by the operation of the switch 50, the operation mode (the second state ST2) transitions to the setting mode (the first state ST1). For example, by operating the switch 50 again, the setting mode (the first state ST1) transitions to the operation mode (the second state ST2). Also, the setting mode (the first state ST1) may transition to the operation mode (the second state ST2) when the time in the first state ST1 exceeds a prescribed period of time. Also, in the first state ST1, the setting mode (the first state ST1) may transition to the operation mode (the second state ST2) when the elapsed time from the operation of the operation buttons 20 exceeds a prescribed period of time.

Thus, in the embodiment, the first state ST1 is the setting mode. In the setting mode, at least one of the multiple operation buttons 20 can perform at least one of the setting of a condition of the operation of the movable part 70 or the setting of the function of at least one of the multiple operation buttons 20. On the other hand, the second state ST2 is the operation mode. In the second state ST2, the displayer 30 does not perform the first display 30D recited above. In the operation mode, at least one of the multiple operation buttons controls an operation of the movable part 70.

Figure 3:
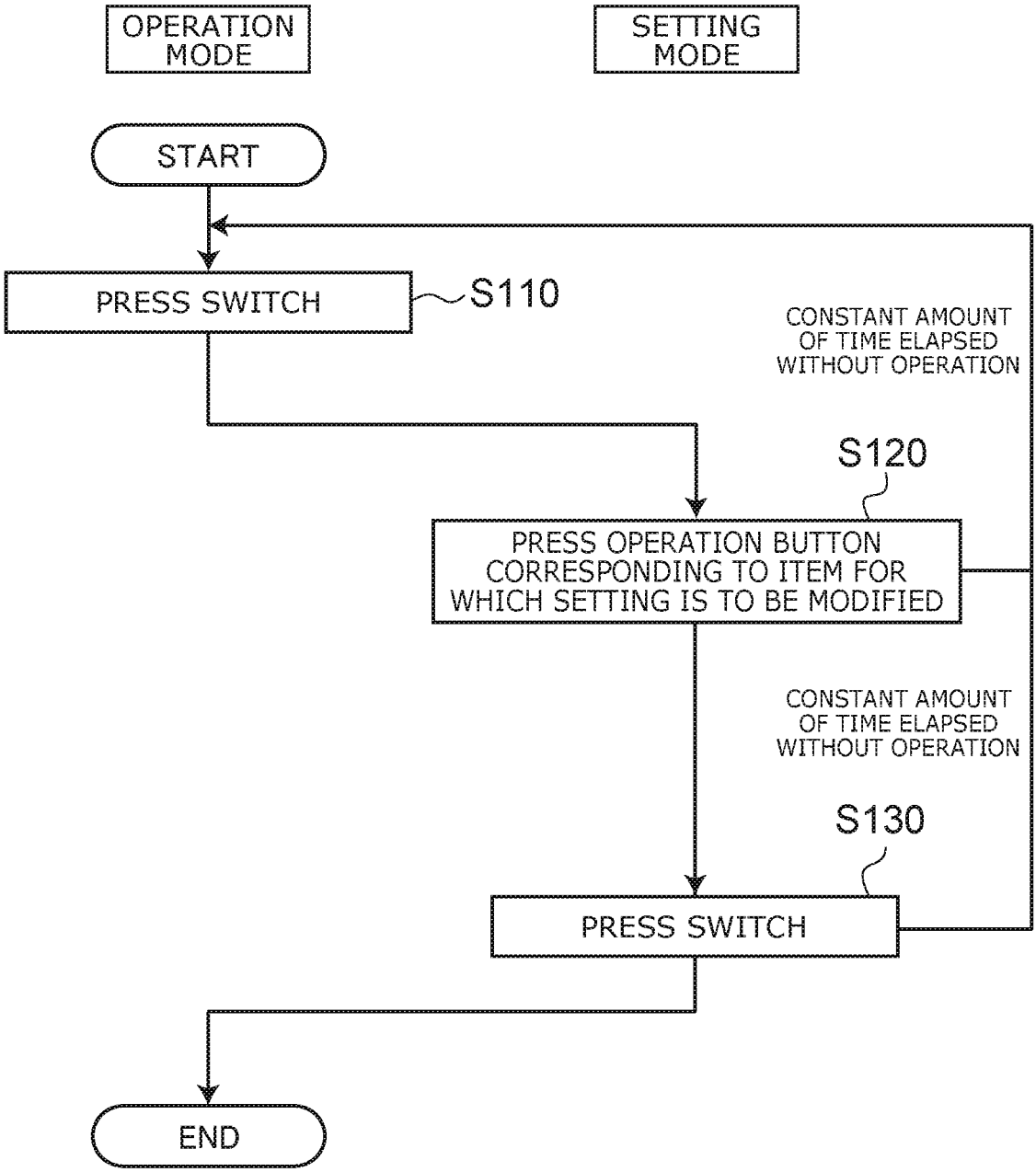
FIG. 3 is a flowchart illustrating an operation of the control device according to the embodiment.

FIG. 3 is a flowchart illustrating the operation of the control device according to the embodiment.

As shown in FIG. 3, the switch 50 is pressed; and the switch 50 accepts the first input (step S110). Thereby, the operation mode (the second state ST2) is switched to the setting mode (the first state ST1). The operation button 20 that corresponds to the item of which the setting is to be modified is pressed; and the second input is received (step S120). In other words, in the setting mode (the first state ST1), at least one of one of the multiple operation buttons 20 or another one of the multiple operation buttons 20 receives the second input. Subsequently, the switch is pressed again (S130). Namely, the switch 50 receives another input. Thereby, the setting mode is switched to the operation mode.

When a prescribed period of time has elapsed without an operation in step S120 recited above, the mode may transition to the operation mode. The mode may return to the operation mode when a prescribed period of time has elapsed without an operation between step S130 and step S120 recited above.

Thus, the displayer 30 turns off the first display 30D when at least one of an elapse of a prescribed period of time from when the switch 50 receives the first input, an elapse of a prescribed period of time from at least one of the multiple operation buttons 20 being operated after the switch 50 receives the first input, or a reception of another input by the switch 50. Then, the state transitions to the second state ST2 (the operation mode).

Figure 4A:
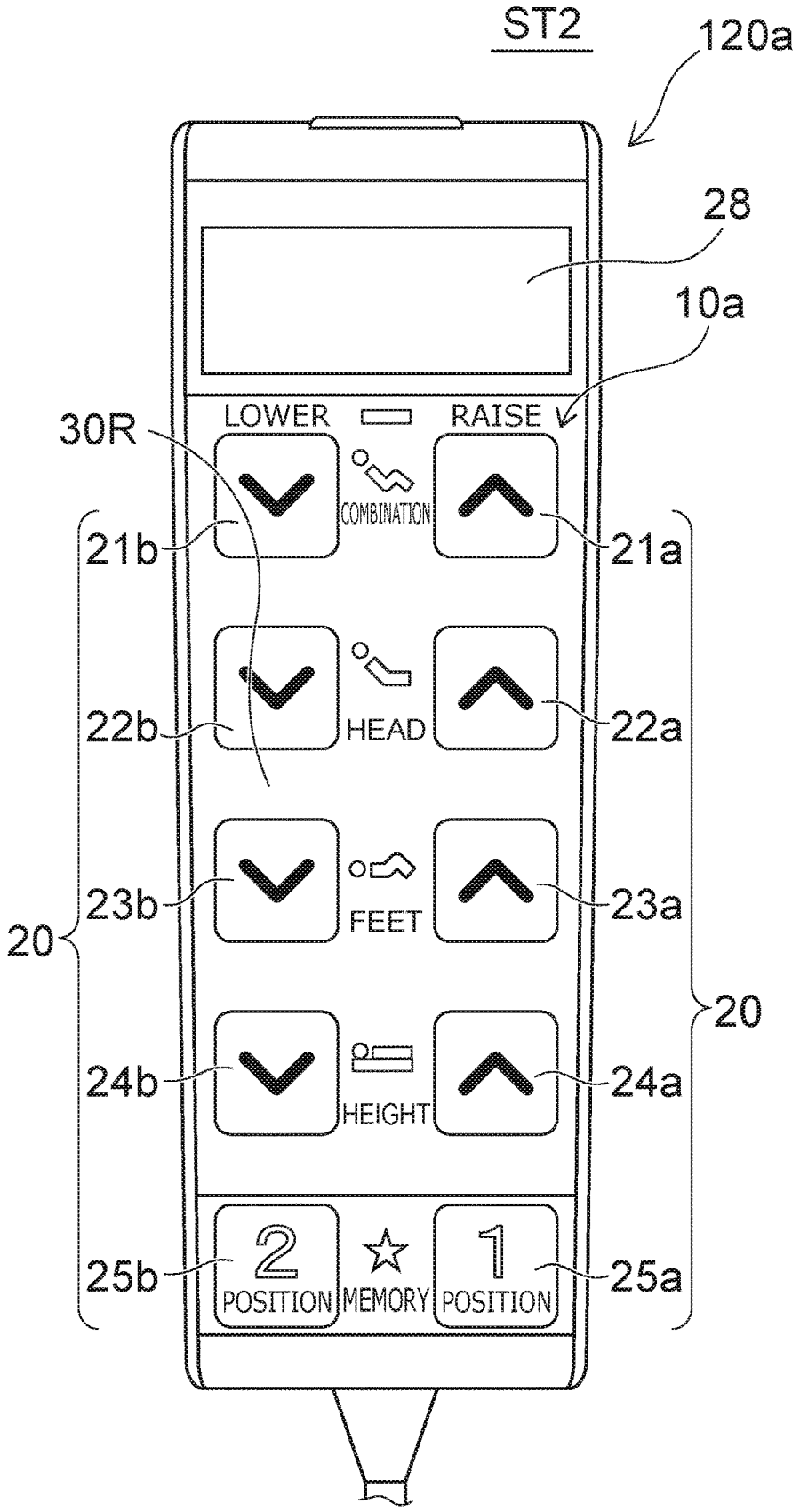
FIG. 4A and FIG. 4B are schematic plan views illustrating another control device according to the embodiment.
Figure 4B:
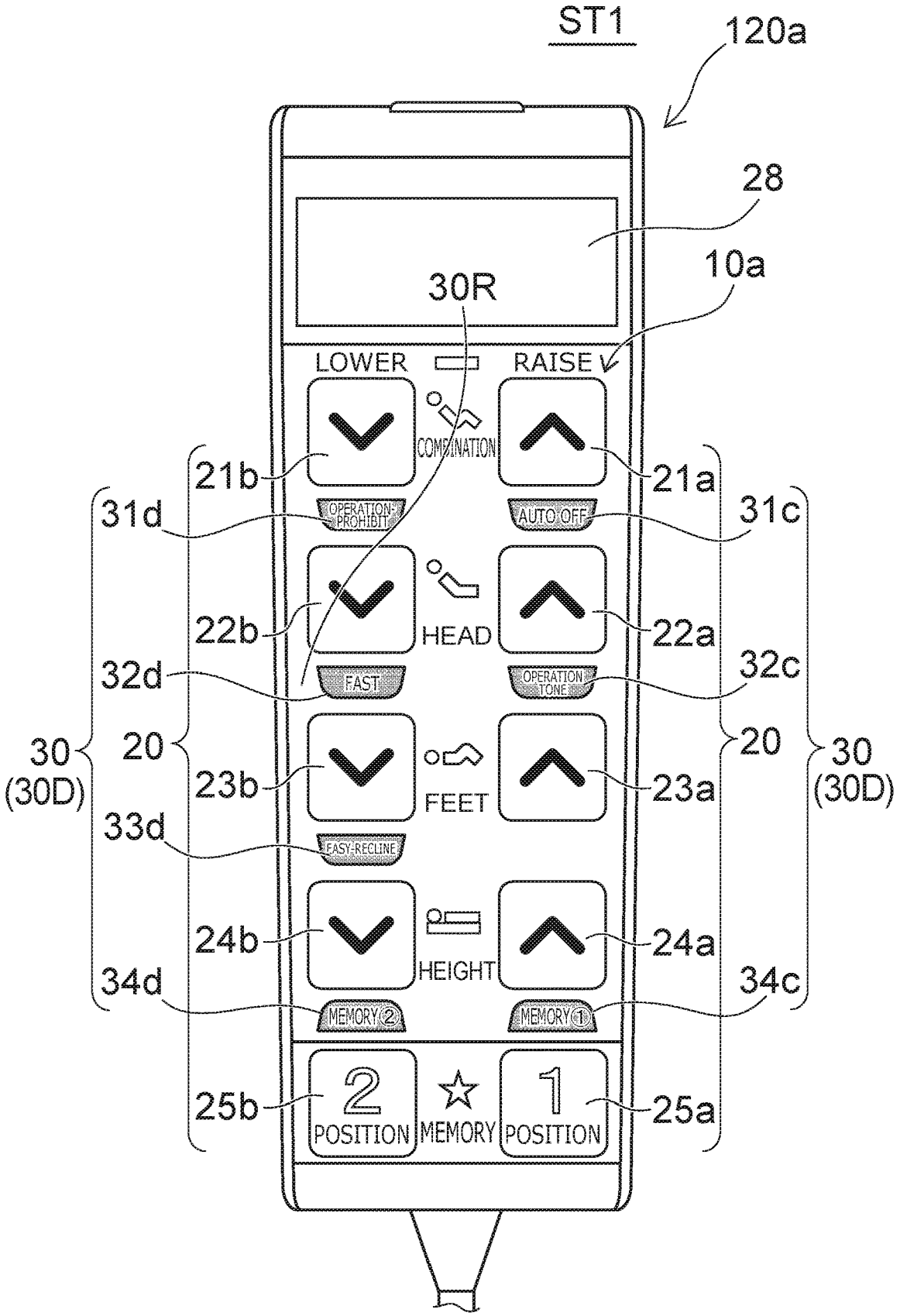

FIG. 4A and FIG. 4B are schematic plan views illustrating another control device according to the embodiment.

For example, FIG. 4A illustrates the operation mode (the second state ST2). FIG. 4B illustrates the setting mode (the first state ST1).

In the operation mode (the second state ST2) illustrated in FIG. 4A, functions of the buttons 21*a*, 21*b*, 22*a*, 22*b*, 23*a*, 23*b*, 24*a*, 24*b*, 25*a*, and 25*b* are the same as the functions described in reference to FIG. 2A.

As shown in FIG. 4B, the control device 120*a* includes the displayer 30. The displayer 30 displays the first display 30D between the multiple operation buttons 20 in the first state ST1 (the setting mode in which the switch 50 receives the first input). In the example, the displayer 30 includes an auto OFF setting display 31*c*, an operation-prohibit setting display 31*d*, an operation tone setting display 32*c*, a speed setting display 32*d*, an "easy-recline" setting display 33*d*, a "memory 1" setting display 34*c*, and a "memory 2" setting display 34*d*. At least a part of the first display 30D is displayed in the region 30R between the multiple operation buttons 20.

In the second state ST2 (the operation mode) as shown in FIG. 4A, the display is not performed by the displayer 30 recited above.

The display (the first display 30D) that corresponds to various setting items is performed when switched to the setting mode.

For example, the button 21*a* that is positioned above the auto OFF setting display 31*c* functions as an inputter for an auto OFF setting in the setting mode. For example, by the operation of the button 21*a*, the conditions of the auto OFF setting, etc., are modified.

For example, the button 21*b* that is positioned above the operation-prohibit setting display 31*d* functions as an inputter for an operation-prohibit setting in the setting mode. For example, by the operation of the button 21*b*, the conditions of the operation-prohibit setting, etc., are modified.

For example, the button 22*a* that is positioned above the operation tone setting display 32*c* functions as an inputter for an operation tone setting in the setting mode. For example, by the operation of the button 22*a*, the conditions of the operation tone, etc., are modified.

For example, the button 22*b* that is positioned above the speed setting display 32*d* functions as an inputter for a speed setting in the setting mode. For example, by the operation of the button 22*b*, the speed of the operation of the movable part 70 or the like is modified.

For example, the button 23*b* that is positioned above the "easy-recline" setting display 33*d* functions as an inputter for an "easy-recline" setting in the setting mode. For example, by the operation of the button 23*b*, the conditions of the "easy-recline" operation are modified. When performing the "back-raising" in the "easy-recline" operation, for example, the "back-raising" is performed after performing the "knee-raising." The setting that relates to this series of operations is performed by the operation of the button 23*b*.

For example, the button 24*a* that is positioned above the "memory 1" setting display 34*c* functions as an inputter for a setting of the "memory 1" (the stored posture) in the setting mode. For example, by the operation of the button 24*a*, one state (posture) of the movable part 70 is stored.

For example, the button 24*b* that is positioned above the "memory 2" setting display 34*d* functions as an inputter for a setting of the "memory 2" in the setting mode. For example, by the operation of the button 24*b*, another one of the states (the postures) of the movable part 70 is stored.

FIG. 5A to FIG. 5D are schematic plan views illustrating another control device according to the embodiment.

Figure 5A:
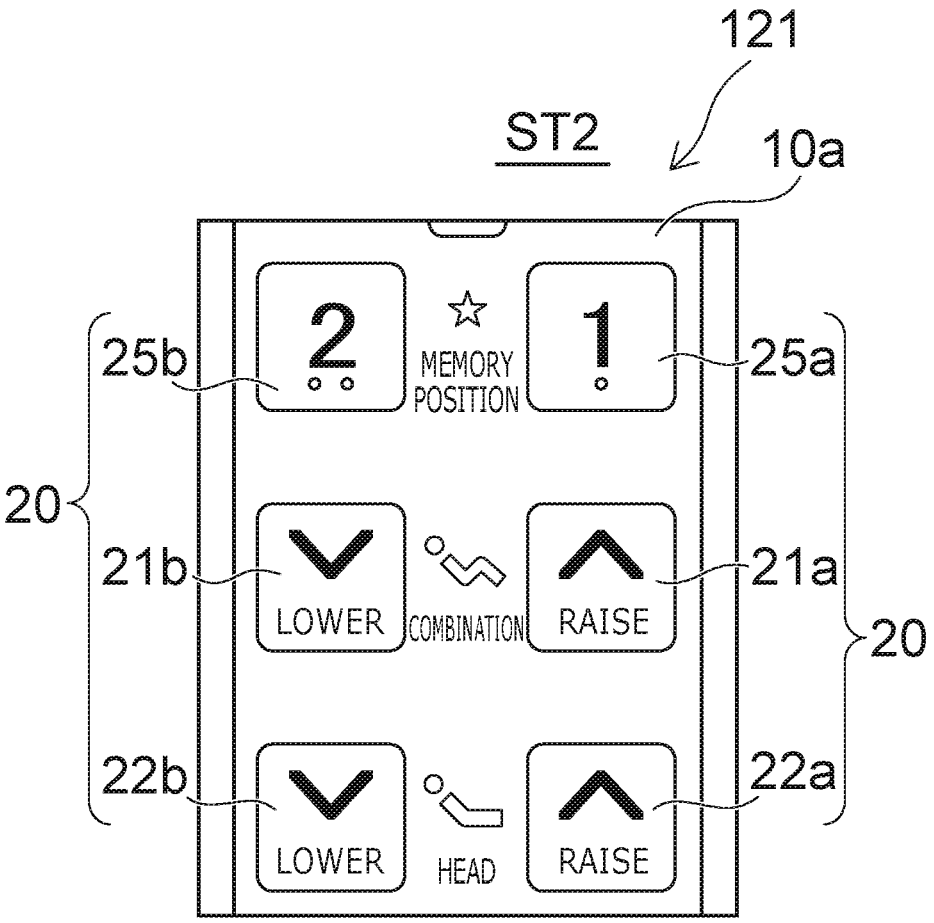
FIG. 5A to FIG. 5D are schematic plan views illustrating another control device according to the embodiment.
Figure 5B:
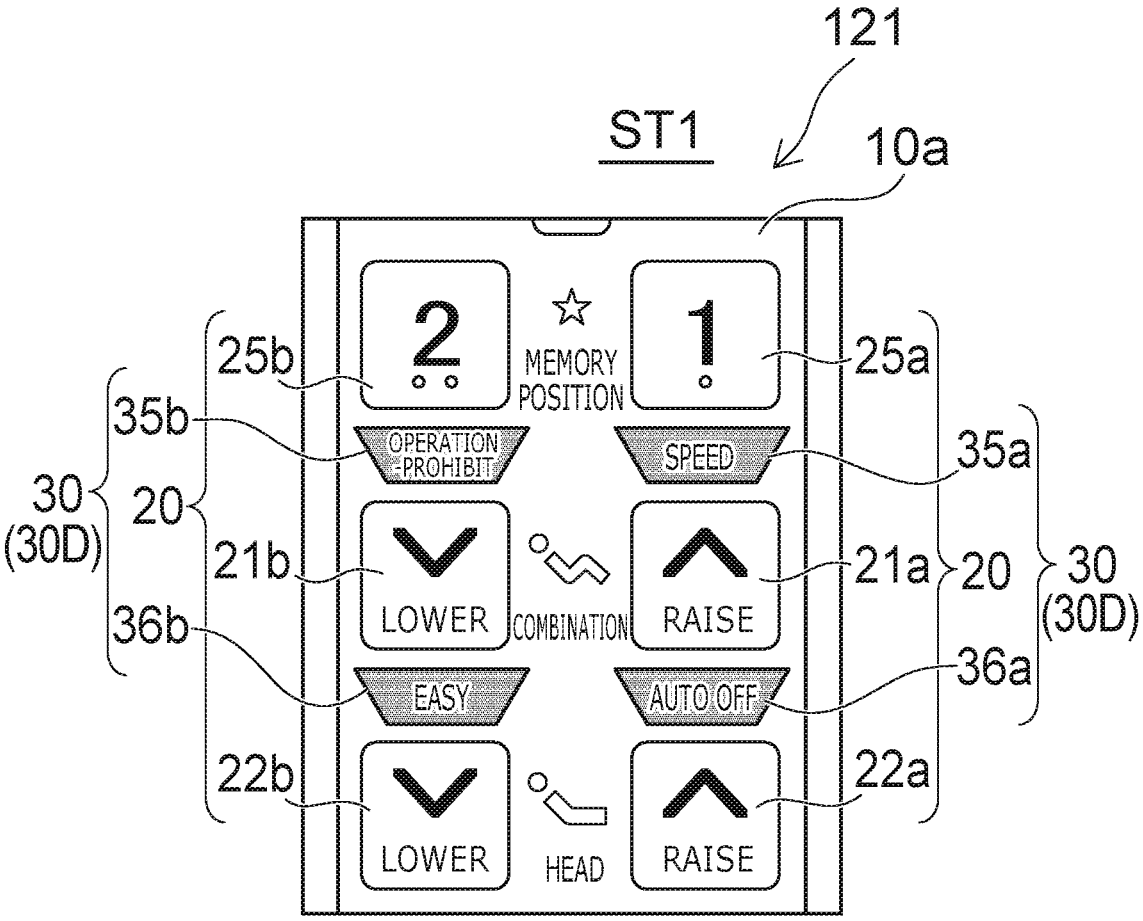
Figure 5C:
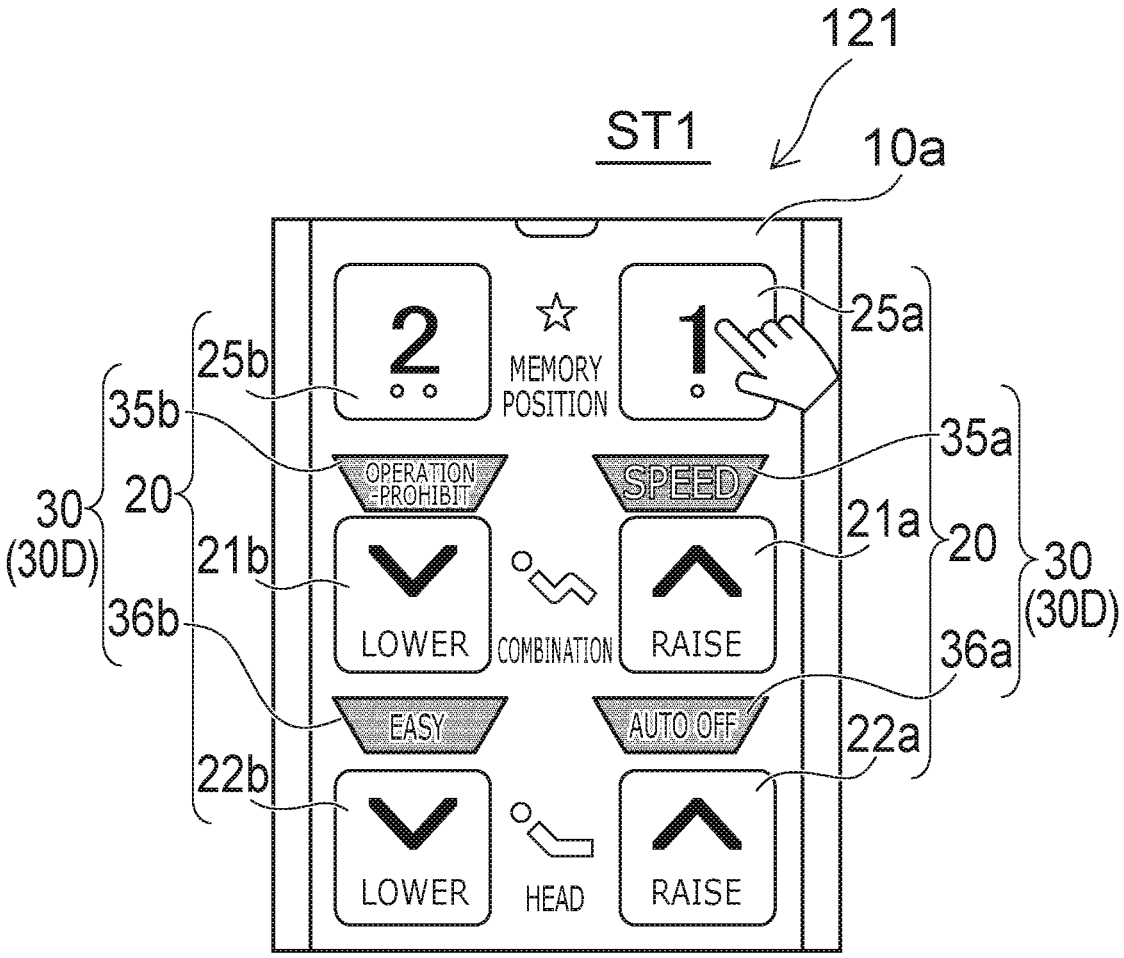
Figure 5D:
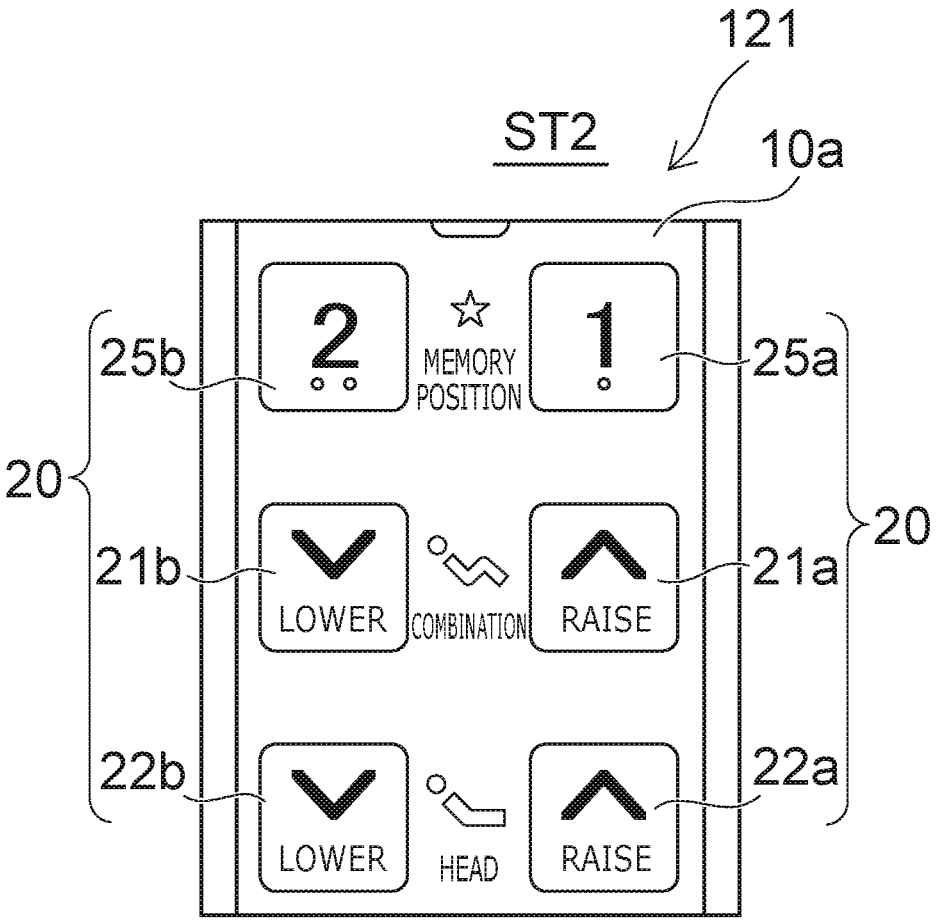

FIG. 5A and FIG. 5D correspond to the second state ST2 (the operation mode). FIG. 5B and FIG. 5C correspond to the first state ST1 (the setting mode). These drawings illustrate the other control device 121 according to the embodiment.

As shown in FIG. 5A, the multiple operation buttons 20 include the button 25*a* relating to the first memory position, the button 25*b* relating to the second memory position, the raise button 21*a* relating to "combination," the lower button 21*b* relating to "combination," the raise button 22*a* relating to "head," and the lower button 22*b* relating to "head." In the second state ST2, the first memory position is formed when the button 25*a* is pressed. In the second state ST2, the second memory position is formed when the button 25*b* is pressed. In the second state ST2, a combination-raise is performed when the button 21*a* is pressed. In the second state ST2, a combination-lower is performed when the button 21*b* is pressed. In the second state ST2, the head of the user is raised when the button 22*a* is pressed. In the second state ST2, the head of the user is lowered when the button 22*b* is pressed.

The switch 50 is pressed; and the displayer 30 performs the first display 30D as shown in FIG. 5B. In the example, the first display 30D includes a speed setting display 35*a*, an operation-prohibit setting display 35*b*, an "auto OFF" setting display 36*a*, and an "easy" setting display 36*b*. The "auto OFF" is, for example, the control of turning off at a prescribed period of time. The "auto OFF" setting display 36*a* is a display relating to the control of the "auto OFF." The "easy" setting display 36*b* is, for example, a display relating to the series of operations of the movable part 70. For example, there is a series of operations in which the "back-raising" is performed after performing the "knee-raising." In this series of operations, there is a back/knee motion operation not including the tilt of the entire section, and a back/knee motion operation including tilting the entire section. The "easy" setting recited above is a control of switching between the two operations (horizontal or tilted).

As shown in FIG. 5C, for example, the button 25*a* that is positioned above the speed setting display 35*a* is pressed. For example, it is displayed that the input using the button 25*a* is accepted by the speed setting display 35*a* flashing. The speed of the operation of the movable part 70 is modified by the input using the button 25*a*.

In addition to the input using the button 25*a*, an input using the other operation buttons 20 may be performed. For example, by the operation of the button 25*b*, the setting of the "operation-prohibit" is modified. For example, by the operation of the button 21*a*, a setting that relates to "auto OFF" is set. For example, by the operation of the button 21*b*, a setting that relates to the "easy" operation is modified.

As shown in FIG. 5D, for example, the state transitions to the second state ST2 (the operation mode) due to the switch 50 being pressed again.

As shown in FIG. 5A and FIG. 5D, the first display 30D is not displayed in the second state ST2. The operation in the operation mode is easy and easy to view because the first display 30D is not performed.

In the embodiment, the displayer 30 may display the state of the movable part 70, etc. For example, the control device includes the multiple operation buttons 20 that can control the operation of the movable part 70 of the electric furniture 310, the acceptance part (e.g., the switch 50), and the displayer 30 (referring to FIG. 2B, etc.). The displayer 30 displays the first display 30D between the multiple operation buttons 20 in the first state ST1 in which the acceptance part receives the first input. The first display 30D may include at least one of the state of the movable part 70 or the state of the multiple operation buttons 20. In such a case as well, the setting mode (the first state ST1) and the operation mode (the second state ST2) are switched by the acceptance part.

Figure 6:
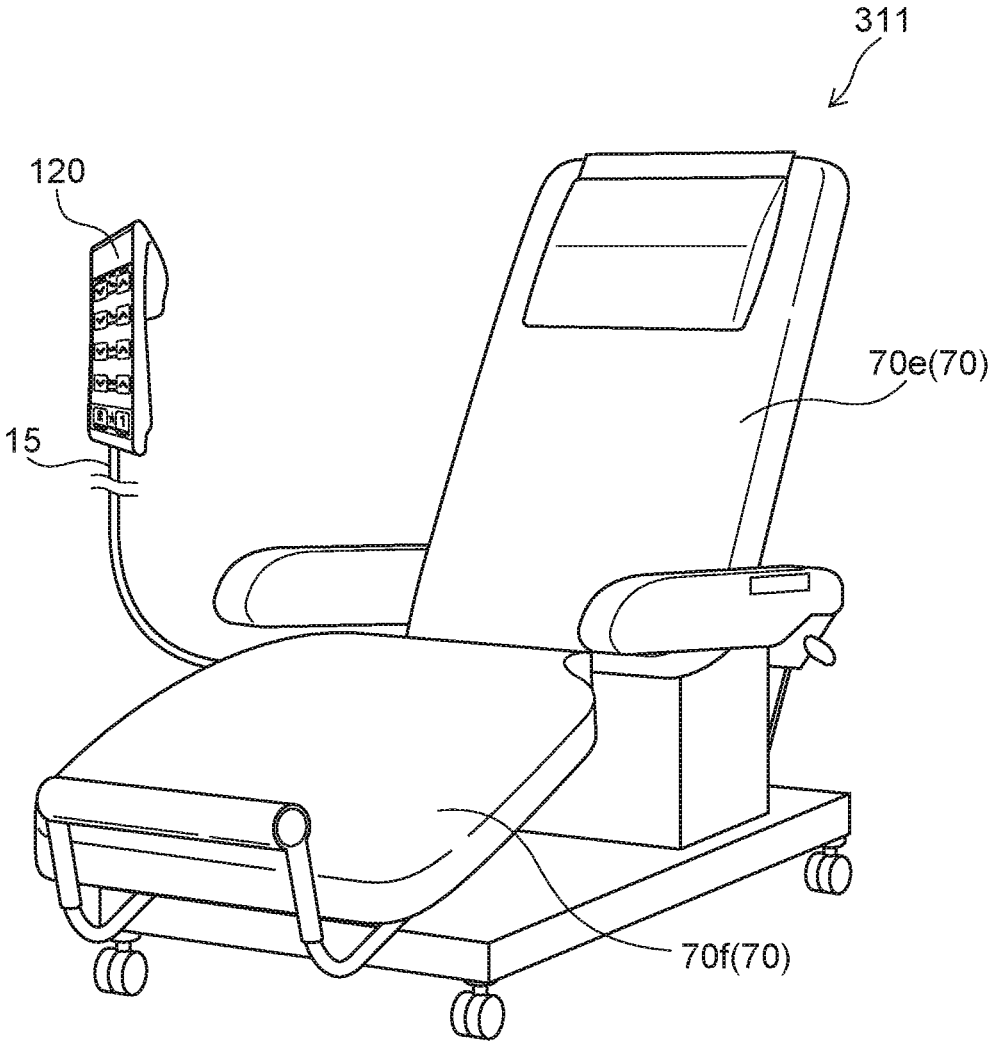
FIG. 6 is a schematic perspective view illustrating another electric furniture including the control device according to the embodiment.

FIG. 6 is a schematic perspective view illustrating another electric furniture including the control device according to the embodiment. As shown in FIG. 6, the electric furniture 311 is an electric reclining chair. The electric furniture 311 includes the movable part 70. The movable part 70 includes, for example, in a backrest part 70*e* and a seat surface part 70*f*. These movable parts 70 are controlled by the control device 120 (or 121) according to the embodiment. In the electric furniture 311 as well, electric furniture can be provided in which the operationability can be improved.

For example, the control device according to the embodiment relates to a remote controller (a handy switch) of electric furniture such as an electric bed, an electric reclining chair, etc. For example, the display of the setting items of the electric furniture (the bed or the like) is performed by the displayer 30. For example, in a reference example in which the setting items are displayed by a large-size touch panel, display device, etc., the size of the control device is large; and the operationability degrades. The cost of such a reference example is high. In the embodiment, for example, the characters that relate to the settings, etc. (the first display 30D) in the setting mode appear to stand out. In the normal mode (the operation mode), the first display 30D is not performed. The display of the control device is simple. A control device and electric furniture that have good operationability can be provided inexpensively.

The embodiments may include the following configurations (e.g., proposals).

Configuration 1

A control device, comprising:

multiple operation buttons capable of controlling an operation of a movable part of electric furniture;

an acceptance part; and a displayer displaying a first display between the multiple operation buttons in a first state, the acceptance part receiving a first input in the first state.

Configuration 2

The control device according to Configuration 1, wherein the displayer turns off the first display when at least one of an elapse of a prescribed period of time from when the acceptance part receives the first input, an elapse of a prescribed period of time from when the at least one of the multiple operation buttons is operated after the acceptance part receives the first input, or a reception of an other input by the acceptance part Occurs.

Configuration 3

The control device according to Configuration 1 or 2, wherein the first display is displayed between one of the multiple operation buttons and an other one of the multiple operation buttons; and in the first state, an operation corresponding to the first display is performed when one of the one of the multiple operation buttons or the other one of the multiple operation buttons receives a second input.

Configuration 4

The control device according to Configuration 3, wherein the operation corresponding to the first display is different from an operation of the multiple operation buttons in a second state in which the displayer does not perform the first display.

Configuration 5

The control device according to Configuration 4, wherein the operation of the multiple operation buttons in the second state includes a control of the movable part.

Configuration 6

The control device according to any one of Configurations 3 to 5, wherein the operation corresponding to the first display includes at least one of a control of a generation of a sound, a control of a short-range wireless communication, a control of paging, a control of an input by a motion sensor, or a control of lighting.

Configuration 7

The control device according to Configuration 4 or 5, wherein the operation corresponding to the first display includes at least one of a switching between accepting and non-accepting an input of the multiple operation buttons in the second state, a modification of a speed of the operation of the movable part, or a control of a storage of a state of the movable part.

Configuration 8

The control device according to Configuration 1 or 2, wherein the first display includes at least one of a state of the movable part or a state of the multiple operation buttons.

Configuration 9

The control device according to Configuration 1, wherein in the first state, at least one of the multiple operation buttons can perform at least one of a setting of a condition of the operation of the movable part or a setting of a function of at least one of the multiple operation buttons.

Configuration 10

The control device according to Configuration 1 or 9, wherein in a second state in which the displayer does not perform the first display, at least one of the multiple operation buttons controls the operation of the movable part.

Configuration 11

Electric furniture, comprising:

the control device according to any one of Configurations 1 to 10; and the movable part.

According to the embodiments, a control device and electric furniture can be provided in which the operationability can be improved.

Hereinabove, embodiments of the invention are described with reference to specific examples. However, the invention is not limited to these specific examples. For example, one skilled in the art may similarly practice the invention by appropriately selecting specific configurations of components included in the control device such as the operation button, the switch, the displayer, etc., from known art; and such practice is within the scope of the invention to the extent that similar effects can be obtained.

Any two or more components of the specific examples can be combined within the extent of technical feasibility and are within the scope of the invention to the extent that the spirit of the invention is included.

Also, all control devices and electric furniture practicable by an appropriate design modification by one skilled in the art based on the control devices and the electric furniture described above as embodiments of the invention also are within the scope of the invention to the extent that the spirit of the invention is included.

Further, various modifications and alterations within the spirit of the invention will be readily apparent to those skilled in the art; and all such modifications and alterations should be seen as being within the scope of the invention.

REFERENCE NUMERAL LIST

10 operation part
10*a*, 10*b* first and second surfaces
15 cable
20 operation button
21*a*, 21*b*, 22*a*, 22*b*, 23*a*, 23*b*, 24*a*, 24*b*, 25*a*, 25*b* buttons
28 display region
30 displayer
30D first display
30R region
31*a* paging setting display
31*b* short-range wireless communication setting display
31*c* auto OFF setting display
31*d* operation-prohibit setting display
32*a* operation-prohibit setting display
32*b* speed setting display
32*c* operation tone setting display
32*d* speed setting display
33*a* "motion S" setting display
33*b* operation tone setting display
33*d* "easy-recline" setting display
34*a* "memorized position" setting display
34*b* lighting setting display
34*c* "memory 1" setting display
34*d* "memory 2" setting display
35*a* speed setting display
35*b* operation-prohibit setting display
36*a* "auto OFF" setting display
36*b* "easy" setting display
50 switch (acceptance part)
70 movable part
70*a* back section
70*b* upper leg section
70*c* lower leg section
70*d* height adjuster
70*e* backrest part
70*f* seat surface part
120, 120*a*, 121 control devices
310, 311 electric furniture
ST1, ST2 first and second states

The invention claimed is:

1. A control device, comprising:

a plurality of operation buttons on a first surface, the plurality of operation buttons capable of controlling an operation of a movable part of electric furniture;

a switch for switching between a first operating state and a second operating state; and a displayer configured to turn on a first display in a region of the first surface between adjacent pairs of buttons in the plurality of operation buttons when in the first operating state and to turn off the first display when in the second operating state.

2. The control device according to claim 1, wherein the displayer turns on the first display when a first input is received by the switch, then turns off the first display after a second input is received by the switch or after the elapse of a first prescribed period of time after the first input or the elapse of a second prescribed period of time after an operation of any of the plurality of operation buttons.

3. The control device according to claim 1, wherein in the first state, one of the plurality of operation buttons causes an operation corresponding to a button label displayed in the first display adjacent to the one of the plurality of operation buttons when the one of the plurality of operation buttons receives a user input.

4. The control device according to claim 3, wherein the operation corresponding to the button label displayed in first display is different from an operation corresponding to a button label printed on the first surface outside the first display, and the one of the plurality of buttons causes the operation corresponding to the button label printed on the first surface when receiving a user input in the second operating state.

5. The control device according to claim 4, wherein operation of the plurality of operation buttons in the second operating state controls movement of the movable part.

6. The control device according to claim 3, wherein operation of the plurality of operation buttons in the first operating state with the first display being displayed includes at least one of a control of a generation of a sound, a control of a short-range wireless communication, a control of paging, a control of an input by a motion sensor, or a control of lighting.

7. The control device according to claim 4, wherein operation of the plurality of operation buttons in the first operating state with the first display being displayed includes at least one of a switching between accepting and non-accepting of a user input made via the plurality of operation buttons while in the second operating state, a modification of a speed of the movement of the movable part, or a control of a storage of a state of the movable part.

8. The control device according to claim 1, wherein, in the first operating state, at least one of the plurality of operation buttons can cause a change of a setting associated with operation of the movable part or a change of a function associated with one of the plurality of operation buttons.

9. The control device according to claim 1, wherein in the second operating state, in which the displayer does not turn on the first display, at least one of the plurality of operation buttons controls the movable part.

10. A piece of electric furniture, comprising:

the control device according to claim 1; and the movable part.

11. The control device according to claim 1, wherein the switch is a hardware switch on a second surface opposite the first surface.

12. The control device according to claim 1, wherein button labels associated with functions of the plurality of operation buttons when in the second operating state are printed on the first surface.

13. The control device according to claim 1, wherein each of the plurality of operation buttons comprises mechanical contact points.

14. The control device according to claim 1, further comprising:

a display screen on the first surface outside the region in which the first display is displayed by the displayer.

15. The control device according to claim 1, wherein the displayer includes a light emitting diode.

16. The control device according to claim 1, wherein the first surface is not a touch panel display screen.

* * * * *